US007034843B2

(12) United States Patent
Nair et al.

(10) Patent No.: US 7,034,843 B2
(45) Date of Patent: Apr. 25, 2006

(54) METHOD AND SYSTEM FOR ADAPTIVE COLOR AND CONTRAST FOR DISPLAY DEVICES

(75) Inventors: Hari N. Nair, Bangalore (IN); Neha Agrawal, Bangalore (IN); Saif Choudhary, Bangalore (IN); Ashish Neema, Bangalore (IN); Arun Johary, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 90 days.

(21) Appl. No.: 10/849,537

(22) Filed: May 18, 2004

(65) Prior Publication Data

US 2005/0035974 A1 Feb. 17, 2005

Related U.S. Application Data

(63) Continuation-in-part of application No. 10/810,137, filed on Mar. 26, 2004, which is a continuation of application No. 10/193,348, filed on Jul. 10, 2002, now Pat. No. 6,778,183.

(51) Int. Cl.
*G09G 5/02* (2006.01)

(52) U.S. Cl. ..... 345/589; 345/617

(58) Field of Classification Search ..... 345/34, 345/60, 179, 182, 223.1, 234, 353, 365, 253–256, 345/603, 672, 673, 678, 650, 655, 198, 200; 358/2.1, 512, 515, 518, 522; 382/162–167, 382/168–172, 274; 702/180; 355/80

See application file for complete search history.

(56) References Cited

U.S. PATENT DOCUMENTS

| | | | |
|---|---|---|---|
| 4,386,345 | A | 5/1983 | Narveson et al. |
| 4,430,665 | A | 2/1984 | Cochran |
| 4,774,580 | A | 9/1988 | Miyasako |
| 5,940,544 | A | 8/1999 | Nako |
| 5,949,918 | A | 9/1999 | McCaffrey |
| 6,008,794 | A | 12/1999 | Ishii |
| 6,023,266 | A | 2/2000 | Eglit et al. |
| 6,172,718 | B1 | 1/2001 | Alvarez et al. |
| 6,239,782 | B1 | 5/2001 | Siegel |
| 6,351,558 | B1 | 2/2002 | Kuwata |
| 6,396,504 | B1 | 5/2002 | Yung et al. |
| 6,400,989 | B1 | 6/2002 | Eckmiller |
| 6,417,891 | B1 | 7/2002 | Cacciatore et al. |

FOREIGN PATENT DOCUMENTS

| | | |
|---|---|---|
| EP | WO 99/10832 A1 * | 4/1999 |
| JP | 2001134235 | 11/1999 |

* cited by examiner

*Primary Examiner*—Matthew C. Bella
*Assistant Examiner*—G. F. Cunningham
(74) *Attorney, Agent, or Firm*—Beyer Weaver & Thomas, LLP

(57) ABSTRACT

Automatically and adaptively controlling contrast and color of a display device by computing a normalized histogram of a current image, computing degrees of correlation between the normalized histogram and a number of template histograms, sorting the template histograms based upon the associated degrees of correlation, selecting a number of the best correlated template histograms based on the sorting, blending the selected the transfer functions associated with the selected template histograms to form a blended transfer function, and applying the blended transfer function to the current image.

35 Claims, 15 Drawing Sheets a - No change in output (Avg brightness $B_A$)
b - Increased contrast, Increased brightness (Avg brightness $B_B$)
c - Decreased contrast, Decreased brightness(Avg brightness $B_C$)

Standard contrast adjustment

Recovering full luma dynamic range ("Snapping")

Dark image template transfer function

Dark image template transfer function

Mid-tone image template transfer function

Mid-tone image template transfer function

Bright image template transfer function

Bright image template transfer function

Snapping the blended template transfer functions

Representative hardware implementation data path

METHOD AND SYSTEM FOR ADAPTIVE COLOR AND CONTRAST FOR DISPLAY DEVICES

CROSS-REFERENCES TO RELATED APPLICATIONS

This application is a continuation in part of U.S. application Ser. No. 10/810,137 filed Mar. 26, 2004 entitled "Method and System for Adaptive Color and Contrast for Display Devices" by Nair et al. which, in turn, is a continuation of U.S. application Ser. No. 10/193,348 filed Jul. 10, 2002 now U.S. Pat. No. 6,778,183 entitled "Method and System for Adaptive Color and Contrast for Display Devices" by Nair et al each of which are hereby incorporated by reference.

FIELD OF THE INVENTION

The present invention relates generally to display devices and particularly to a system and method that provides adaptive color and contrast for a display device.

BACKGROUND OF THE INVENTION

A display device renders input data as a two-dimensional image in color or grayscale. The input data may be graphical in nature. An example of such a device is a PC display monitor. The input data may be a video signal. An example of such a device is a TV or video monitor. The input data may be a combination of graphics and embedded video. An example of such a device is a PC display monitor displaying graphics with one or applications displaying video in a window, or a PC/TV display device with two or more input ports displaying graphics or full-screen video or a combination of graphics and video, e. G. Picture-in-Picture.

A viewer typically manually controls the color and contrast of a display device. The issue with manual control is that it does not result in optimal display quality for all possible input data. For example, setting the contrast control to increase the contrast of a washed out image will result in over-contrasty images for a normal image. Decreasing the color saturation setting for a highly saturated image would be optimal, but if the input changes to a de-saturated image, this setting would now be sub-optimal. It is not feasible or convenient for a viewer to continuously change display settings to adapt to the nature of the input image, particularly when the input is a video sequence.

Another problem with manual control of contrast and color is that it is not sensitive to the nature of the input data. Manual contrast control applies a multiplicative factor to the input luma component. This is shown graphically in FIG. 1. Due to the finite dynamic range of luma values, increasing the contrast of a dark image in order to be able to see the shadow details results in loss of information in the bright highlights. The multiplicative nature of this control also implies that there is no possibility of increasing the contrast of a predominantly bright image.

Accordingly, what is needed is a system and method to address the above-identified problems. The present invention addresses such a need.

SUMMARY OF THE INVENTION

A method and apparatus that allows a display device to adaptively and automatically control display contrast and color is disclosed.

In one embodiment, a method for automatically and adaptively controlling contrast and color of a display device is disclosed. The method can be carried out by the following operations, computing a normalized histogram of a current image, computing degrees of correlation between the normalized histogram and a number of template histograms, sorting the template histograms based upon the associated degrees of correlation, selecting a number of the best correlated template histograms based on the sorting, blending the selected transfer functions associated with the selected template histograms to form a blended transfer function, and applying the blended transfer function to the current image.

In another embodiment, computer program product for automatically and adaptively controlling contrast and color of a display device is described. The computer program product includes computer code for computing a normalized histogram of a current image, computer code for computing degrees of correlation between the normalized histogram and a number of template histograms, computer code for sorting the template histograms based upon the associated degrees of correlation, computer code for selecting a number of the best correlated template histograms based on the sorting, computer code for blending the selected the transfer functions associated with the selected template histograms to form a blended transfer function, computer code for applying the blended transfer function to the current image, and computer readable medium for storing the computer code.

In still another embodiment, an apparatus for automatically and adaptively controlling contrast and color of a display device is described. The apparatus includes means for computing a normalized histogram of a current image, means for computing degrees of correlation between the normalized histogram and a number of template histograms, means for sorting the template histograms based upon the associated degrees of correlation, means for selecting a number of the best correlated template histograms based on the sorting, means for blending the selected the transfer functions associated with the selected template histograms to form a blended transfer function, and means for applying the blended transfer function to the current image.

A system for adaptive color contrast of an image displayed on a display device is also disclosed. The system includes a controlling state machine adapted to receive a vertical data enable signal and an input luma signal, a memory block coupled to the controlling state machine adapted to receive input luma and provides an output luma, a creation of histogram block coupled to and controlled by the state machine, a histogram average block coupled to and controlled by the state machine, a template weight calculator block coupled to and controlled by the state machine, a template transfer function black coupled to and controlled by the state machine, a snapping function block coupled to and controlled by the state machine that provides final blended transfer function to the memory and an adaptive chroma correction block coupled to and controlled by the state machine adapted to receive the output and the input chroma provide a final output chroma, wherein collection of a current image histogram is performed during an active frame wherein when a vertical inactive period (blanking) starts, the histogram is averaged, if necessary, with previous image histograms and the template transfer function weights are calculated and the template transfer functions are blended using these weights and the snapping operation is performed on the blended output to recover the full dynamic range and a new contrast transfer function is written to a luma LUT memory that is used for the next image frame.

DETAILED DESCRIPTION

The present invention relates generally to display devices and particularly to a system and method that provides adaptive color and contrast for a display device. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

Digital Display Device: an electronic image display device that uses digitized (sampled and quantized) image data. The input data itself may be analog in nature, and digitized within the device for display on a digital display such as an LCD, OLED or plasma panel. Alternatively, the input data itself may be digital in nature and finally displayed on an analog display such as a CRT.

Pixel: the smallest discrete region on a digital display device that can be addressed for display.

Luma: the component of the input image data value that is correlated to the perceived intensity of the displayed data value.

Chroma: the component of the input image data value that is correlated to the perceived color of the displayed data value. Hue and saturation are two commonly used color perceptions that together define the chroma value.

A system and method in accordance with the present invention continuously analyzes the input data and responding by manipulating the color and contrast of the display device. The system is both adaptive and automatic. The term adaptive is used to signify that the proposed solution continuously generates an appropriate response based on an analysis of the input data. The term automatic is used to signify that there is no viewer interaction required for this process.

The apparatus in accordance with the present invention may be hardware, software, or a combination of hardware and software. An example of a pure hardware solution would be an FPGA or ASIC design. An example of a hardware and software implementation would be a DSP and embedded firmware.

Figure 1:
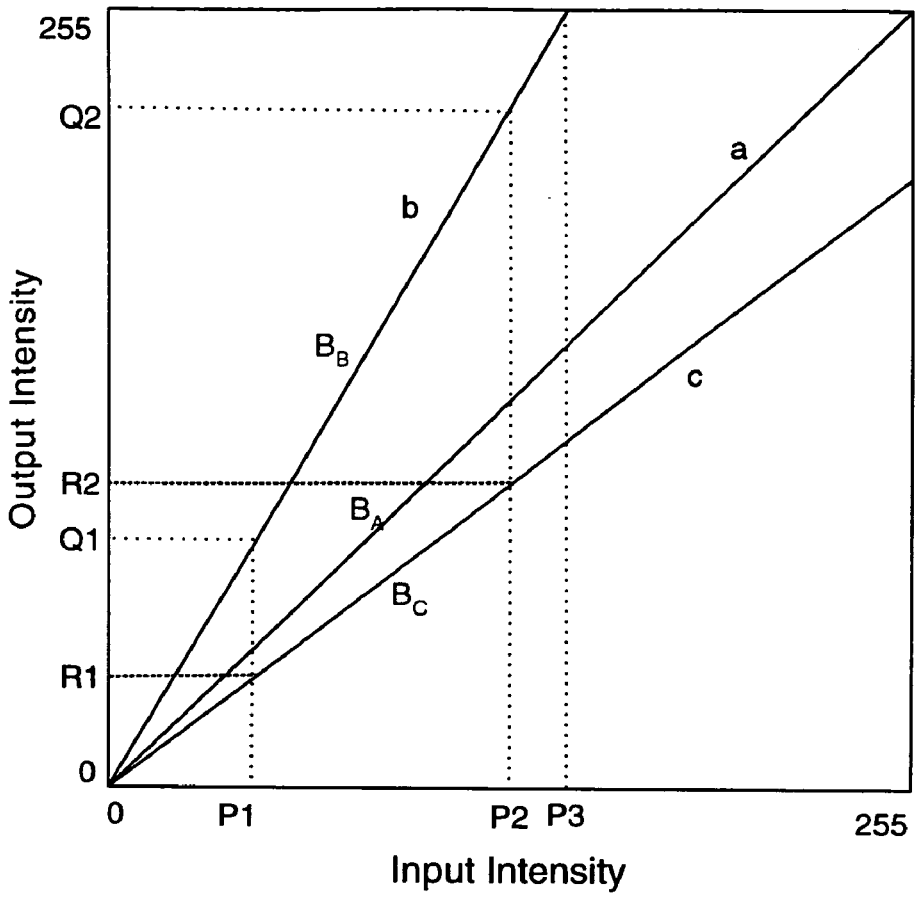
FIG. 1 illustrates a standard contrast adjustment.
Figure 2:
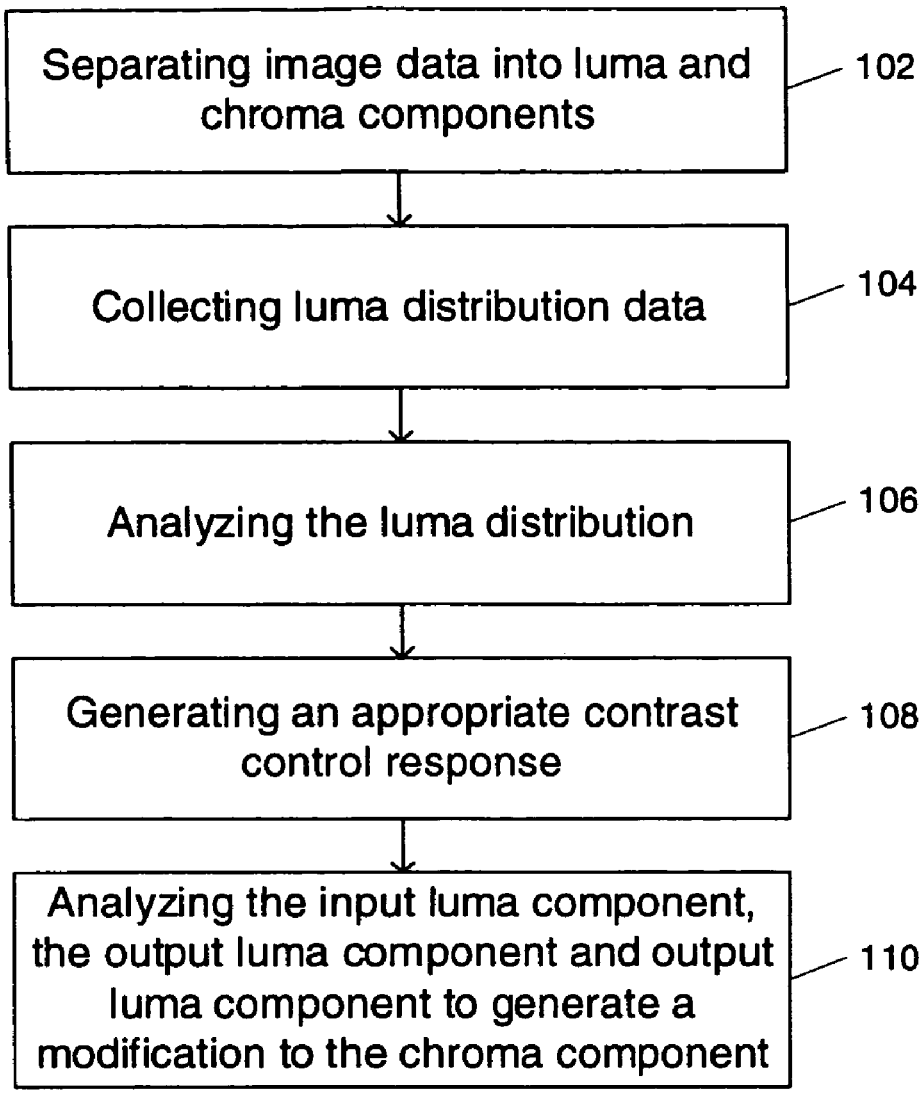
FIG. 2 is a flow chart illustrating adaptive color contrast in accordance with the present invention.

The method and system in accordance with the present invention is described in a preferred embodiment by the below-identified sequential steps in conjunction with FIG. 2. FIG. 2 is a flow chart illustrating adaptive color contrast in accordance with the present invention.

Separating an input image data value into its luma and chroma components, via step 103.

Collecting the luma distribution data over the entire image or a specified window, via step 104.

Analyzing the luma distribution, via step 106.

Generating an appropriate contrast control response that modifies the input luma component to generate an output luma component, on a pixel by pixel basis, via step 108.

Analyzing the input luma component and the output luma component, and an input chroma component, to generate an appropriate modification for the chroma component, on a pixel by pixel basis, via step 110.

Each of the steps will be described in detail hereinbelow.

Separating Input Data into Luma and Chroma Components (Step 102).

If the input data is already formatted as luma+chroma, this process is not required. If the input is in some other format, such as RGB, this process will generate the luma and chroma components.

Collecting Luma Distribution Data (Step 104).

This process divides the range of luma values into a number of overlapping bands and counts the number of input luma data values that fall within each of these bands, over the entire image or a specified window in the image. An image window will normally be specified when the desired control response needs to be confined to a window on the screen. This window could for example be a Picture-In-Picture video window, or an embedded video window within a graphics screen.

At the end of this process, the luma distribution is defined by a set of band indices and their corresponding counts. This statistical distribution table is the luma histogram.

In addition, the darkest and brightest luma data values found are also stored. These values can be either determined by the actual minimum and maximum values found in the image, or from a cumulative analysis of the luma histogram. For example, the minimum luma could be determined as the value beyond which 99% of the image luma values are found. The maximum luma could be determined as the value below which 99% of the image luma values are found.

Analyzing Luma Distribution Data (Step 106).

If the input data luma range is very evenly distributed over the range from black to white, this will reflect in the count values being approximately equal. If the input data luma values are clustered around certain portions of the entire range, this will reflect in different count values for different bands.

For example, a relatively high count in the lower bands corresponds to a predominantly dark image. A relatively high count in the upper bands corresponds to a predominantly bright image. A relatively high count in the middle bands corresponds to a mid-tone image. For each of these image categories, it is possible to pre-define an optimal contrast control response.

Figure 3:
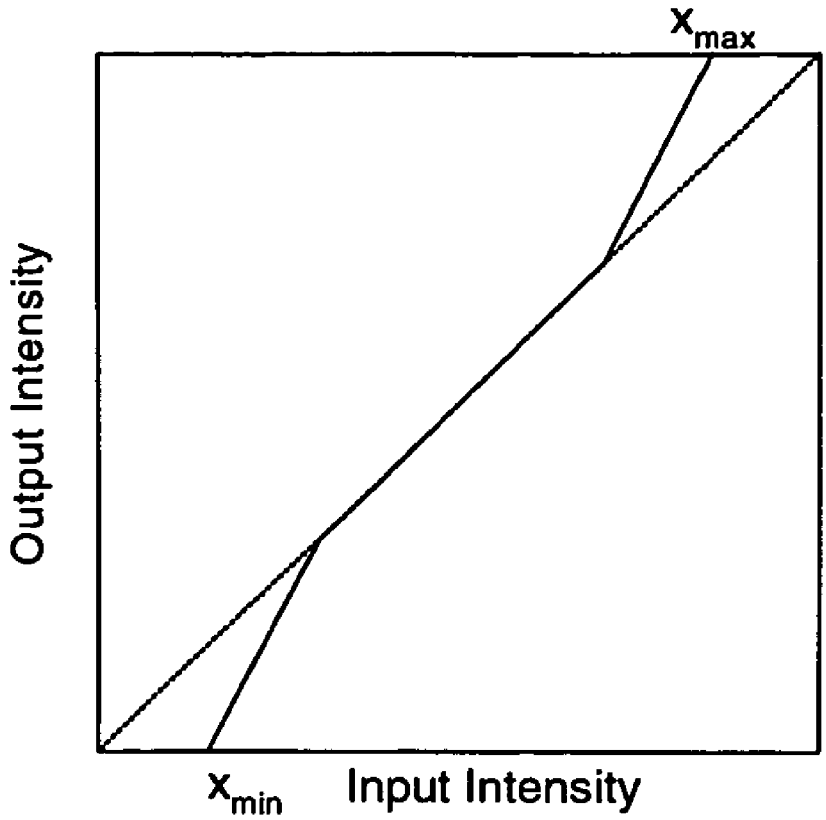
FIG. 3 illustrates a "snapping" process.

The darkest and brightest luma data values indicate the dynamic range of the input luma data. If this is less than the available dynamic range available, it is desirable to remap the luma values to fully utilize the available dynamic range for maximum visual quality. For example, assuming a normalized luma range of 0 to 1, if the darkest luma value is 0.2 and the brightest luma value is 0.9, it is possible to remap the input range of 0.2–0.9 to the range 0.0–1.0. This "snapping" process is shown in FIG. 3.

Generating Appropriate Contrast Control Response (Step 108).

Figure 4A:
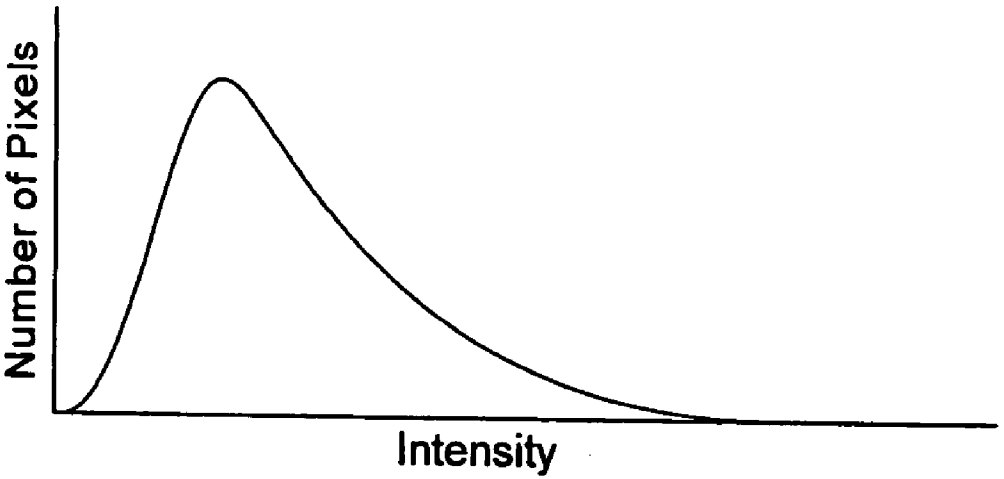
FIG. 4A illustrates the dark range case.
Figure 4B:
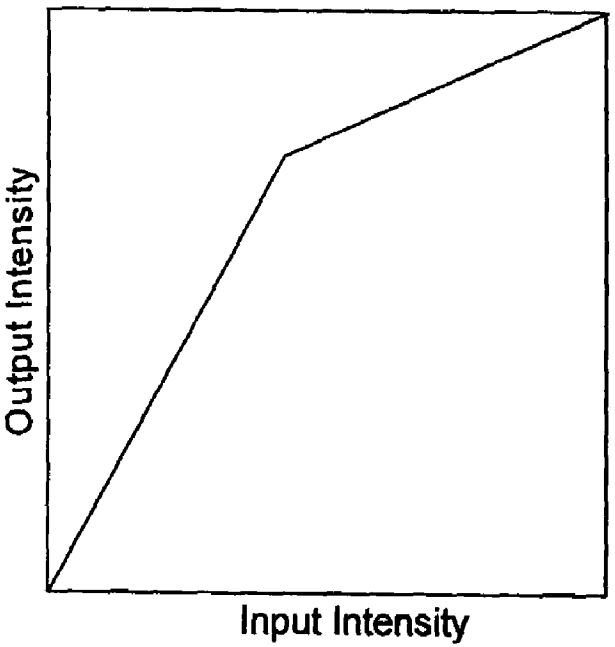
FIG. 4B illustrates the transfer function of the dark range case of FIG. 4A.

This method specifies an optimal contrast control response for a limited subset of the universe of possible luma distributions. For example, if three luma bands are used for analysis, it is possible to specify three control responses that are optimal for the following cases:

Dark image: relatively high band count in first band, compared to other two bands Mid-tone image: relatively high band count in middle band, compared to other two bands Bright image: relatively high band count in last band, compared to other two bands For the dark image case, a suitable contrast control response expands the dark image pixel dynamic range, and compresses the bright pixel dynamic range. FIG. 4 illustrates the dark range case and its transfer function.

Figure 5A:
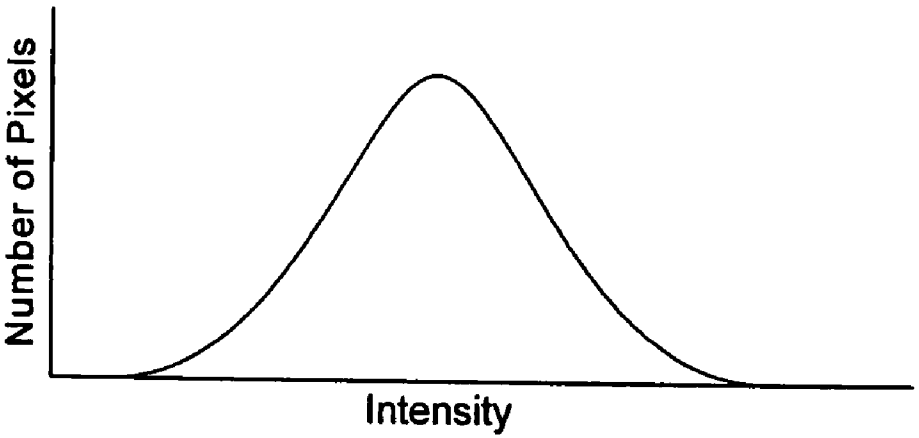
FIG. 5A illustrates the mid-tone range case.
Figure 5B:
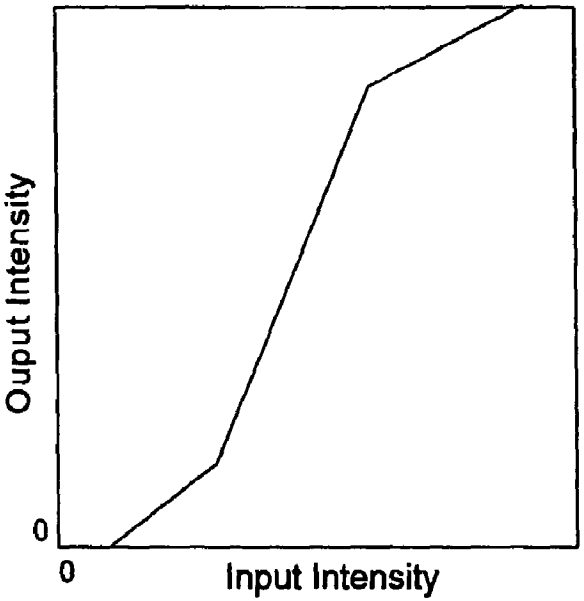
FIG. 5B illustrates the transfer function of the mid tone range case of FIG. 5A.

For the mid-tone image case, a suitable contrast control response expands the mid-tone dynamic range, and compresses the dark and bright image dynamic range. FIG. 5 illustrates the mid-tone range case and its transfer function.

Figure 6A:
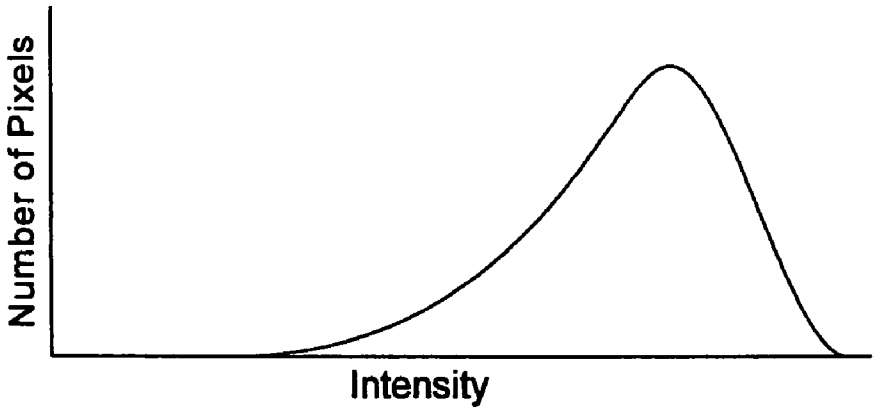
FIG. 6A illustrates the bright range case.
Figure 6B:
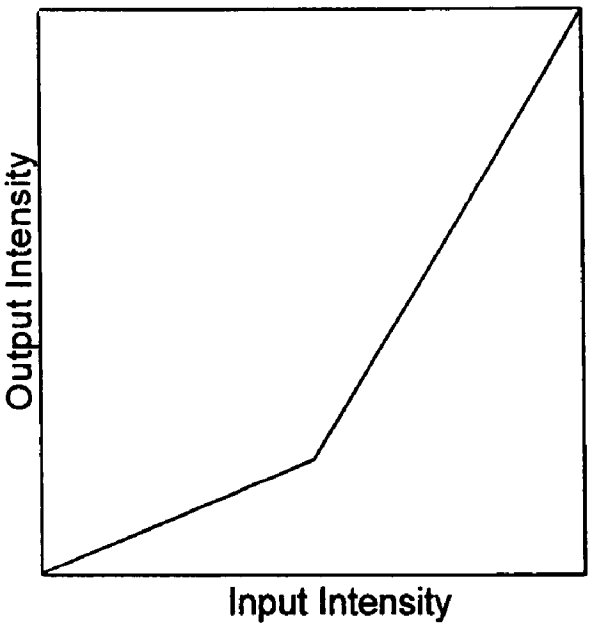
FIG. 6B illustrates the transfer function of the bright range case of FIG. 6A.

For the bright image case, a suitable contrast control response expands the bright pixel dynamic range and compresses the dark pixel dynamic range. FIG. 6 illustrates the bright range case and its transfer function.

These control responses are user definable so that any desired contrast control can be applied.

For an actual input luma distribution, the relative luma counts in the different bands are used to determine how well the actual luma distribution correlates to the chosen subset of luma distributions.

This method then blends the predefined control responses for the subset of luma distributions using the relative luma counts as a blending weight. For example if the actual luma counts are relatively high in both dark and mid-tone bands and low in the bright region, the blending process will generate a control response that is predominantly a blend of the appropriate control responses for dark images and mid-tone images.

Figure 7:
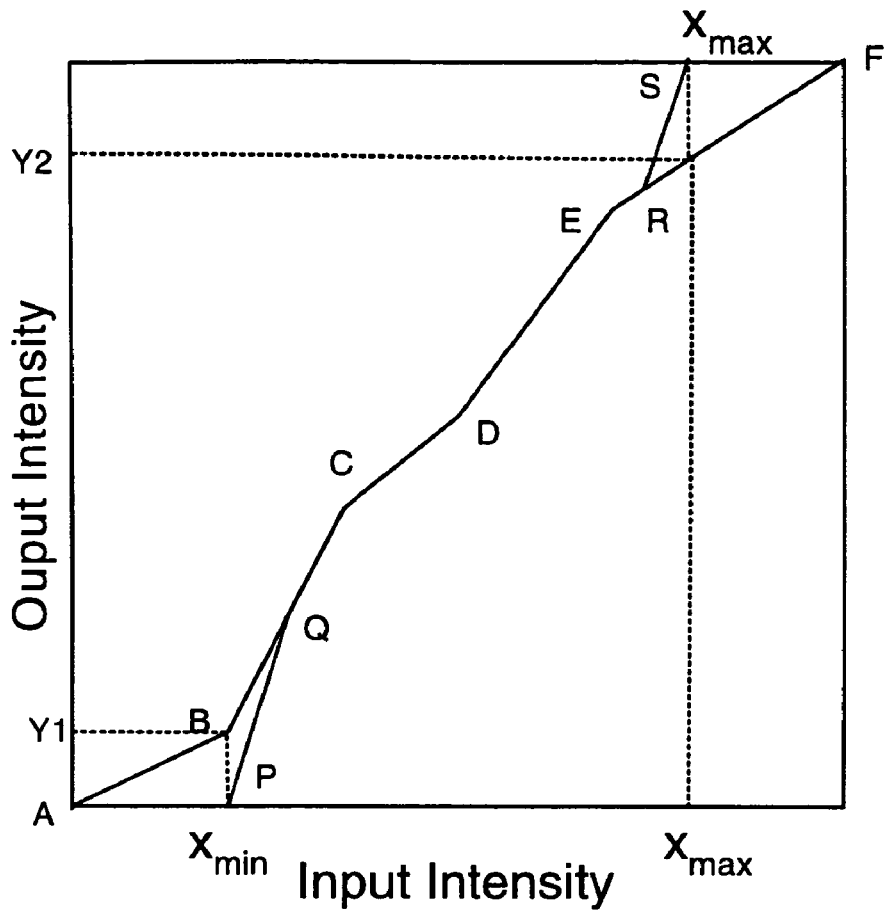
FIG. 7 illustrates modifying the blended contrast control response so that display dynamic range is fully utilized.

Finally, the computed darkest (Xmin) and brightest (Xmax) luma values are used to modify the blended contrast control response so that display dynamic range is fully utilized. This is shown in FIG. 7.

Analyzing modified luma followed by generation of non-linear chroma correction factor (step 110).

This method analyzes on a pixel by pixel basis the incoming luma value and outgoing modified luma value, and generates an appropriate adjustment for the chroma component. The chroma adjustment maintains or enhances the perceived color saturation of the picture when the contrast has been increased. The chroma correction applied is determined by the difference between the luma output and the luma input to the luma LUT and is non-linear. If the incoming pixel already is highly saturated, the amount of additional chroma correction is decreased.

Figure 8:
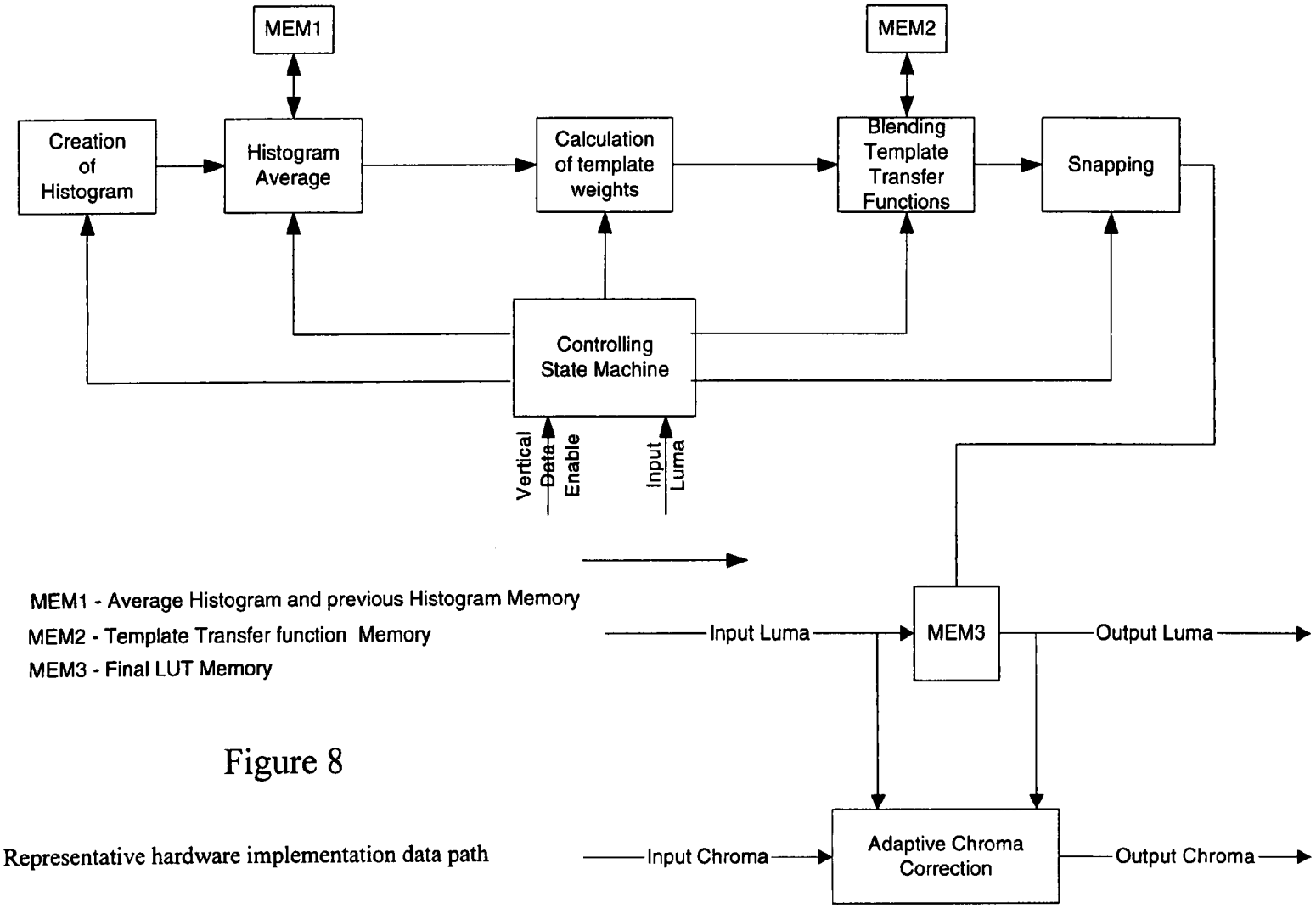
FIG. 8 shows a representative hardware data path diagram.

A representative hardware data path diagram 200 is shown in FIG. 8. In this figure, a controlling state machine 202, receives a vertical data enable signal and an input luma signal. The state machine 202 controls a creation of histogram black 204, a histogram average 206, template weight calculator 208, a template transfer function black 210 and a snapping function block 212. Memory 214 stores average histogram and the previous histogram. Memory 216 stores the template transfer function.

The snapping function block 212 provides final blended transfer function to memory 218. The memory receives input luma and provides an output luma. The input luma, output and the input chroma is provided to the adaptive chroma correction block 220. The adaptive chroma correction block provides the output chroma.

In this system, the collection of the current image histogram is performed during the active frame, which is signaled, for example, by the vertical data enable signal at logic 1. When the vertical inactive period (blanking) starts, the histogram is averaged if necessary with previous image histograms. Then the template transfer function weights are calculated and the template transfer functions are blended using these weights. Finally the snapping operation is done on the blended output to recover the full dynamic range and the new contrast transfer function is written to the luma LUT memory. This new lookup table is used for the next image frame.

The contrast of an input image can be improved by applying a piece wise linear transfer function (that depends on the input image) to the image. In order to determine the transfer function for any image, the image has to first be analyzed in order to derive an associated histogram that would, in turn, determine the transfer function for that image.

In motion sequences, consecutive frames are usually similar enough that the transfer function of a previous frame can be applied on a next frame. In this way, the transfer function for one frame can be used for the next frame (i. E., the transfer function determined for a frame N is applied to frame N+1 and so on). However, by extending this concept, the transfer function of frame N can be applied to the next K frames where K is firmware programmable.

In order to use a number of previous frames to determine a transfer function for a current frame, histogram averaging of the previous M frames is performed and based upon this averaging a decision is made concerning transfer function to be applied to the current frame. In order to generate the histograms, the input histogram is compared with histograms of any of a number of predefined templates and based on the comparison with the template histograms, a confidence level (weights) for each template is determined that indicates how close the input histogram is to the predefined template histogram. It should be noted that each predefined template has associated with it a predefined transfer function that is optimal for it. Thus, using the confidence levels, the transfer functions of a number $N_b$ of the best transfer functions are blended together to form a final transfer function. If none of the templates match, then a default transfer function is applied. In any case, the blended (or in some cases, the default) transfer function will be applied to the next frame(s).

For each template there is a predefined transfer function as well as an extra default transfer function. It should be noted that the number of transfer functions was chosen as sixteen (16) merely to accommodate all the transfer functions as an integer number of bytes. As such, any number of transfer functions can be used deemed appropriate for the application at hand. In the described embodiment, therefore, the 16 transfer functions include one default transfer function and 15 transfer functions corresponding to each template (i. E., there are 15 templates in all). The input histogram is formed as a binned histogram with 16 bins such that for each input pixel, its intensity is determined and the count of that bin (which has the input intensity) is incremented by 1 thereby forming the input binned histogram where the height of each bin depends on the total number of pixels in the input image. In the described embodiment, the maximum number of pixels as $2^{24}$ therefore requiring on the order of 24 bits to store the bin count. In this case, since the input luminance is an eight bit number and only 16 bins are being supported (i. E., 4 bits) a number of selectable options can be made available. Two such options include:

A) truncate the 8 bit luminance to a 4 bit bin by ignoring the lower 4 bits, or

B) dither the lower 4 bits using a 4×4 ordered dither sequence into the upper 4 bits.

In order to compare the current (or actual) histogram with the predefined template, both histograms must be normalized to the same reference. Accordingly, the predefined templates are normalized for a cumulative sum of 256. In this way, the current histogram adds up to the total number of pixels ($N_{tot}$).

Figure 9:
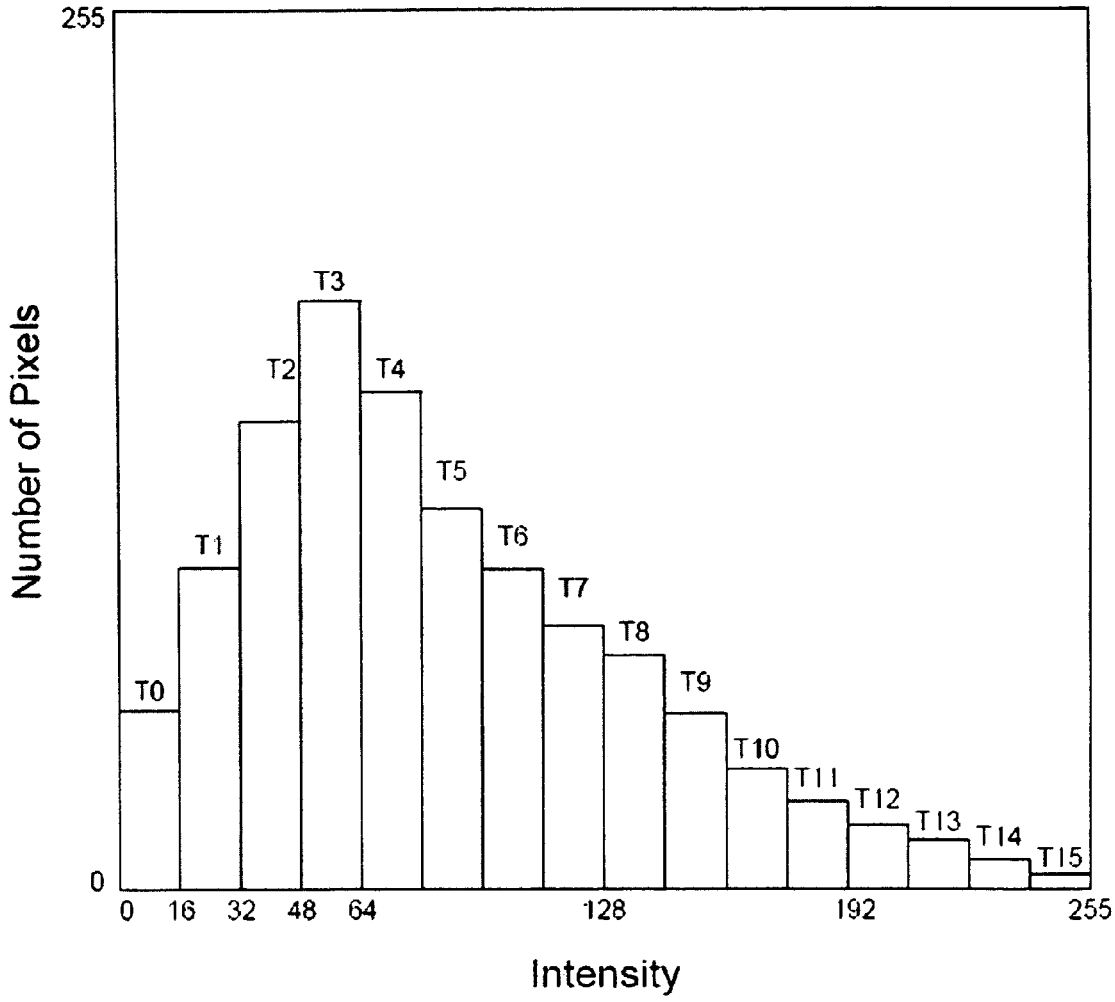
FIG. 9 shows a representative input histogram in accordance with an embodiment of the invention.

One approach to normalization would be to scale the current histogram from a cumulative total of $N_{tot}$ to 255 that can be done by multiplying the histogram population count by $255/N_{tot}$. However, since this approach requires a division operation, an alternative approach normalizes the predefined histogram to $N_{tot}$. This requires the predefined template to be multiplied (scaled) by $N_{tot}/255$ and since the predefined templates have to be loaded into the hardware only once, this "scaling" operation can be performed in firmware before the templates are loaded in the hardware. It should be noted that, the templates will have to be rescaled and reloaded in the hardware every time the instrumentation (video window detection) size changes (which will not happen too frequently and therefore does not present a serious problem). The size of the template can be mitigated by further scaling the templates and the current histogram by a binary scaling factor ($1/2^k$), where k is a (firmware) programmable number that depends only on $N_{tot}$ that is chosen such that the (raw template)*($N_{tot}/255$)*($1/2^k$) fits into a 8 bit number. In order to compare the input histogram with the templates, the height of each bin is normalized to 255 resulting in an input histogram as shown in FIG. 9.

Figure 10:
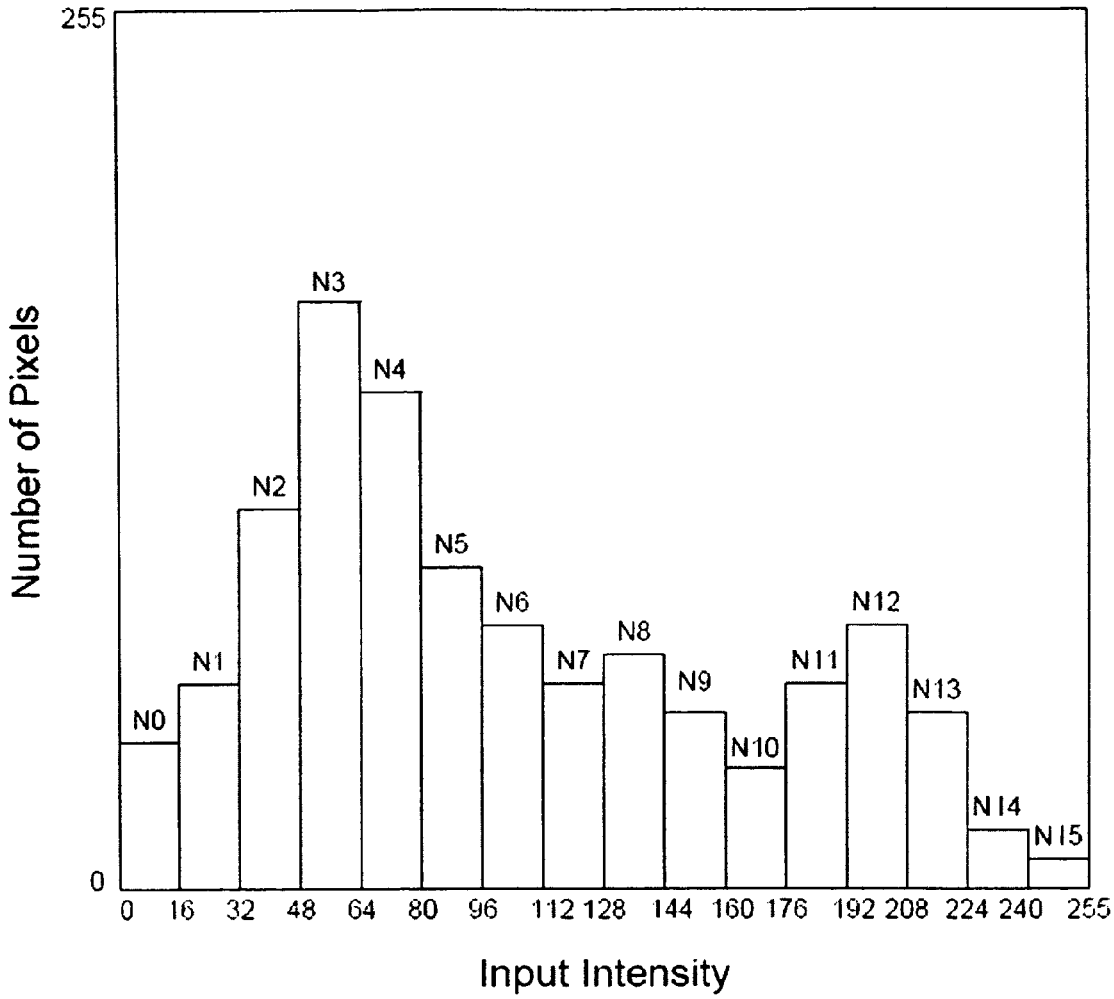
FIG. 10 shows an example of a normalized histogram in accordance with an embodiment of the invention.

In the described embodiment, the templates are represented by a binned histogram. For example, in order to cover an 8-bit luminance range, a binned histogram formed of 16 bins each with a bin width of 16 can be used an example of which is shown in FIG. 10. As shown, all the pixels with intensities between 0 and 15 lie in the first bin where the height of the bin represents the total number of pixels in a particular bin and the sum of all the bins has been normalized to 255. Therefore, if, for example, all pixels lie in a particular bin then the height of that bin would be 255 and all others 0.

In order to compare the input histogram with each predefined template to find the templates that match our input histogram the best, for one template at a time, the absolute differences of the heights of each bin are determined and add together. For example, in the case shown in FIG. 10, Σabs(Ni-Ti), for i=0 to 15 is evaluated for all 15 predefined templates where this value is the lowest for the template that matches the most to the input. Next, the appropriate weights are calculated that indicate which template matched the best, which matched the second best and so on up to the $N_b^{th}$ best (in the described embodiment, $N_b$ is taken to be four (4)).

At this point, the four templates that are a best match to the input image histogram have been identified where each template is associated with a predefined transfer function The transfer functions of these four templates are then blended according to their weights to produce the final transfer function. While blending, the four transfer functions to be blended are calculated on the fly and appropriate weights are applied to get the final transfer function. The final transfer function is then stored in an on-chip lookup table. This lookup table is then used for the next frame(s) to translate all the luminance values.

In a particular implementation, the histogram matching and computation of the transfer function has to be done by a hardware state machine in the vertical retrace interval. This puts a requirement that there be a minimum amount of time (clock cycles) in the vertical retrace interval. Typical vertical retrace intervals are of the order of 20–40 lines. For a VGA resolution display, the number of clocks per line is about 800. So we can safely expect 800*20=16,000 clock cycles to be available in the vertical retrace interval. To be further safe, we will require that all the computations needed must be completed in less than 4000 clock cycles.

Figure 11:
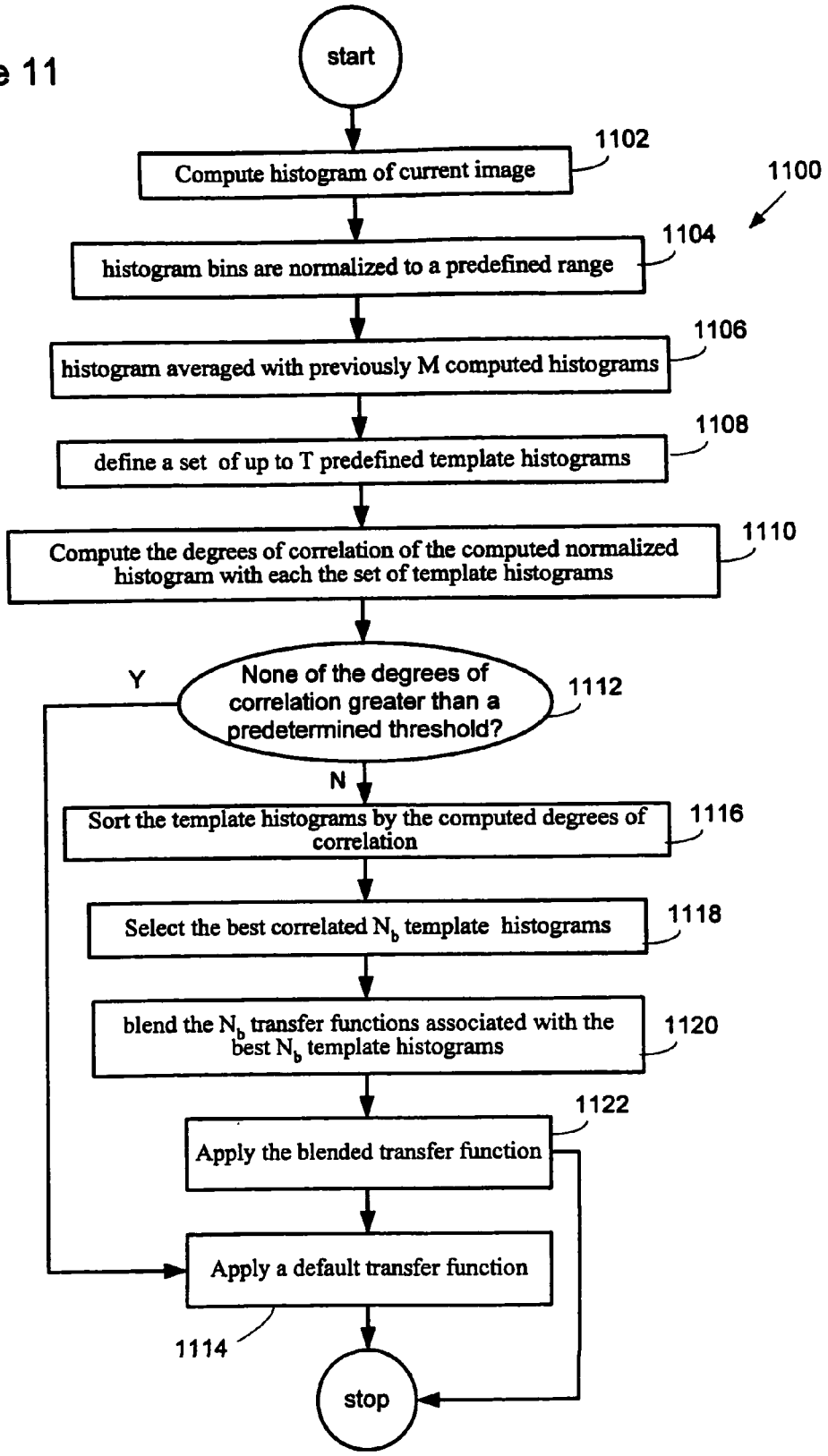
FIG. 11 shows a flowchart detailing a process 1100 used for adaptive color and contrast control in accordance with an embodiment of the invention.

FIG. 11 shows a flowchart detailing a process 1100 used for adaptive color and contrast control in accordance with an embodiment of the invention. The process 1100 is implemented by the following operations. At 1102, compute a histogram of current image using a number N bins (N being, for example, 16) where the number N can be programmable in order to accommodate any number of different environments. In the described embodiment, the histogram bin values can range from 0 to $N_{total}$ where $N_{total}$ is the total number of pixels in the image. Next, at 1104, the histogram bins are normalized to a predefined range (for example, 0 to 255) for computational and storage efficiency Next at 1106, the histogram is averaged with the previously M computed histograms, where M is programmable. It should be noted that the averaging could be accomplished in any of a number of ways, such as performing a running average. Next, at 1108, a set of up to T predefined template histograms (e. G. T=16) are defined where each template histogram describes a specific image category and each template histogram has a predefined and programmable transfer function associated with it that is optimal for that image category.

Next, at 1110, compute the degrees of correlation of the computed normalized histogram with the set of template histograms. In the described embodiment, the correlation is computed as a sum of absolute differences of the computed normalized histogram bins with the template histogram bins. It should be noted that the number of template histograms is programmable as well.

At 1112, a determination is made that is none of the degrees of correlation is greater than a predetermined threshold value, then a default transfer function is applied at 1114, otherwise, control is passed to 1116 where the template histograms are then sorted by the degree of correlation. At 1118, the best correlated $N_b$ template histograms are selected (where $N_b$ is any suitable number, such as $N_b$=3) and at 1120, the selected $N_b$ transfer functions associated with the best $N_b$ template histograms are then blended using blending weights to generate a blended transfer function which is applied at 1122. In the described implementation, the blending is done linearly where the blending weights are proportional to the correlation weights of each of the $N_b$ best histograms.

It should be noted that in order to preserve memory resources, the transfer functions can be stored in compressed form as difference coded LUTs where the initial LUT value for pixel value 0 is stored at full bit resolution. Since the transfer function is continuous and monotonic the subsequent LUT values are coded as the difference from the previous value. In this way, the actual LUT value for index p is then computed incrementally from index 0 by adding all the stored LUT difference values from 1 through p−1.

Figure 12:
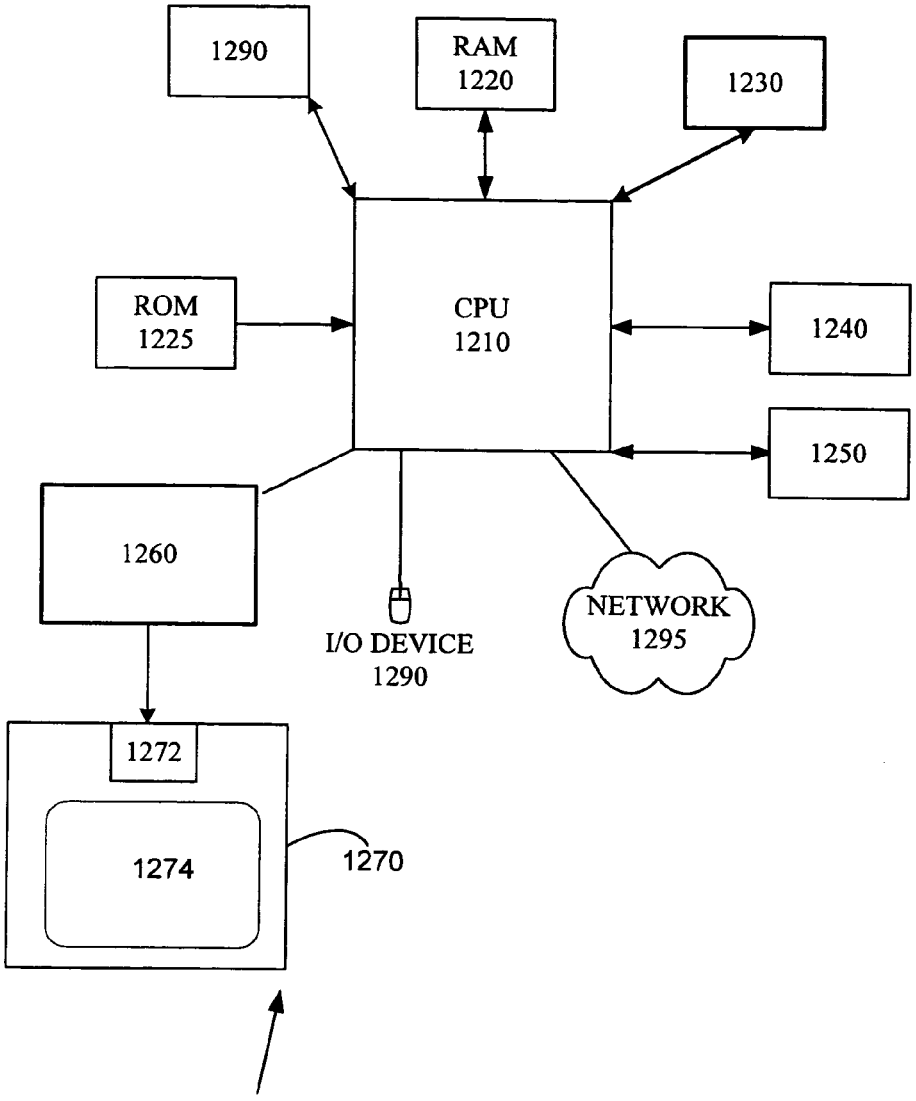
FIG. 12 illustrates a system employed to implement the invention.

FIG. 12 illustrates a system 1200 employed to implement the invention. Computer system 1200 is only an example of a graphics system in which the present invention can be implemented. System 1200 includes central processing unit (CPU) 1210, random access memory (RAM) 1220, read only memory (ROM) 1225, one or more peripherals 1230, graphics controller 1260, primary storage devices 1240 and 1250, and digital display unit 1270. CPUs 1210 are also coupled to one or more input/output devices 1290 that may include, but are not limited to, devices such as, track balls, mice, keyboards, microphones, touch-sensitive displays, transducer card readers, tablets, styluses, voice or handwriting recognizers, or other well-known input devices such as, of course, other computers. Graphics controller 1260 generates image data and a corresponding reference signal, and provides both to digital display unit 1270. The image data can be generated, for example, based on pixel data received from CPU 1210 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats. For example, image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents., and equivalents as fall within the true spirit and scope of the present invention.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for automatically and adaptively controlling contrast and color of a display device, comprising:

computing a normalized histogram of a current image;

computing degrees of correlation between the normalized histogram and a number of template histograms;

sorting the template histograms based upon the associated degrees of correlation;

selecting a number of the best correlated template histograms based on the sorting;

associating each of the selected template histograms with a corresponding transfer function;

blending the transfer functions to form a blended transfer function; and applying the blended transfer function to the current image.

2. The method of claim 1, wherein the current image is a video frame $V_n$, included in a video formed of a number L video frames.

3. The method as recited in claim 2, further comprising:

applying the blended transfer function to video frames $V_{n+1}$ to video frame $V_{n+k}$.

4. The method of claim 3, further comprising:

averaging the normalized histogram with a previous number M normalized histograms each of which is associated with a particular video frame.

5. The method of claim 1, further comprising:

if none of the degrees of correlation is greater than a predetermined threshold value, then applying only a default transfer function to the current image.

6. The method of claim 1, wherein the histogram is normalized to a predefined range.

7. The method of claim 1, further comprising:

analyzing the pixel luma distribution, by collection and analysis of pixel luma distribution using multiple bands; and generating a luma and a chroma control response.

8. The method of claim 7 in which the multiple bands include overlapping bands.

9. The method of claim 8 that collects pixel luma distribution information using bin counters for each band.

10. The method of claim 9 in which the collection of pixel luma distribution information is limited to a user-definable region in the display.

11. The method of claim 10 in which the application of automatic and adaptive contrast and color control is to a user-definable region in the display.

12. The method of claim 10 in which an optimal contrast control response is generated by analysis of the actual luma distribution followed by blending of user defined contrast control responses.

13. The method as recited in claim 1, wherein the computing a degree of correlation between the normalized histogram and a template histogram comprises:

determining an absolute difference of the heights of each bin of the template histogram and the normalized histogram; and adding the absolute differences together.

14. The method as recited in claim 13, wherein the best correlation is the lowest value of the adding.

15. The method of claim 1 in which RGB, YUV, YCrCb, YPrPb or any other color domain are utilized.

16. The method of claim 15 in which analog or digital displays are utilized.

17. The method of claim 2 wherein the histogram for a particular frame is stored in a memory.

18. Computer program product for automatically and adaptively controlling contrast and color of a display device, comprising:

computer code for computing a normalized histogram of a current image;

computer code for computing degrees of correlation between the normalized histogram and a number of template histograms;

computer code for sorting the template histograms based upon the associated degrees of correlation;

computer code for selecting a number of the best correlated template histograms based on the sorting;

computer code for associating each of the selected template histograms with a corresponding transfer function;

computer code for blending the transfer functions to form a blended transfer function;

computer code for applying the blended transfer function to the current image; and computer readable medium for storing the computer code.

19. The computer program product of claim 18, wherein the current image is a video frame $V_n$, included in a video formed of a number L video frames.

20. The computer program product as recited in claim 19, further comprising:

computer code for applying the blended transfer function to video frames $V_{+1}$ to video frame $V_{n+k}$.

21. The computer program product of claim 20, further comprising:

computer code for averaging the normalized histogram with a previous number M normalized histograms each of which is associated with a particular video frame.

22. The computer program product of claim 18, further comprising:

computer code for applying only a default transfer function to the current image if none of the degrees of correlation is greater than a predetermined threshold value.

23. The computer program product of claim 18, wherein the histogram is normalized to a predefined range.

24. The computer program product of claim 18, further comprising:

computer code for analyzing the pixel luma distribution, by collection and analysis of pixel luma distribution using multiple bands; and computer code for generating a luma and a chroma control response.

25. The computer program product of claim 24 in which the multiple bands include overlapping bands.

26. The computer program product of claim 25 that collects pixel luma distribution information using bin counters for each band.

27. The computer program product of claim 26 in which the collection of pixel luma distribution information is limited to a user-definable region in the display.

28. The computer program product of claim 27 in which the application of automatic and adaptive contrast and color control is to a user-definable region in the display.

29. The computer program product of claim 27 in which an optimal contrast control response is generated by analysis of the actual luma distribution followed by blending of user defined contrast control responses.

30. The computer program product as recited in claim 18, wherein the computing a degree of correlation between the normalized histogram and a template histogram comprises:

computer code for determining an absolute difference of the heights of each bin of the template histogram and the normalized histogram; and computer code for adding the absolute differences together.

31. The computer program product as recited in claim 30, wherein the best correlation is the lowest value of the adding.

32. The computer program product of claim 18 in which RGB, YUV, YCrCb, YPrPb or any other color domain are utilized.

33. The computer program product of claim 32 in which analog or digital displays are utilized.

34. The computer program product of claim 19 wherein the histogram for a particular frame is stored in a memory.

35. An apparatus for automatically and adaptively controlling contrast and color of a display device, comprising:

means for computing a normalized histogram of a current image;

means for computing degrees of correlation between the normalized histogram and a number of template histograms;

means for sorting the template histograms based upon the associated degrees of correlation;

means for selecting a number of the best correlated template histograms based on the sorting;

means for associating each of the selected template histograms with a corresponding transfer function;

means for blending the transfer functions to form a blended transfer function; and means for applying the blended transfer function to the current image.

* * * * *